US010236600B2

(12) United States Patent
Berg et al.

(10) Patent No.: US 10,236,600 B2
(45) Date of Patent: Mar. 19, 2019

(54) ELECTRIC TERMINAL BLOCK WITH A SEPARATOR THAT IS DISPLACEABLE TO/FROM BETWEEN CONTACT ELEMENTS

(71) Applicant: Phoenix Contact GmbH & Co. KG, Blomberg (DE)

(72) Inventors: Peter Berg, Schlangen (DE); Thorsten Heil, Bad Salzuflen (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/367,539

(22) Filed: Dec. 2, 2016

(65) Prior Publication Data

US 2017/0162955 A1 Jun. 8, 2017

(30) Foreign Application Priority Data

Dec. 3, 2015 (DE) ..... 10 2015 121 057

(51) Int. Cl.
*H01R 9/26* (2006.01)
*H01R 9/24* (2006.01)
*H01R 13/70* (2006.01)

(52) U.S. Cl.
CPC ..... *H01R 9/24* (2013.01); *H01R 9/2633* (2013.01); *H01R 9/2675* (2013.01); *H01R 13/70* (2013.01)

(58) Field of Classification Search
CPC . H01R 31/08; H01R 9/24; H01R 9/26; H01R 4/36; H01R 4/363
USPC ..... 439/507, 512, 709, 716, 810, 811
See application file for complete search history.

(56) References Cited

U.S. PATENT DOCUMENTS 3,157,453 A * 11/1964 Lanczi ..... H01R 9/26 439/716
3,315,219 A * 4/1967 Brinser ..... H01R 9/26 439/474
3,437,983 A * 4/1969 Gilissen ..... H01R 4/4818 439/716
3,456,231 A * 7/1969 Zimmerman, Jr. .... H01R 13/20 439/516
3,915,545 A * 10/1975 Saito ..... H01R 9/26 439/724

(Continued)

*Primary Examiner* — Thanh Tam T Le
(74) *Attorney, Agent, or Firm* — David S. Safran; Roberts Mlotkowski Safran Cole & Calderon, P.C.

(57) ABSTRACT

A terminal block having a terminal housing, at least two electrically conductive contact elements, at least two conductor connection elements for connecting electric conductors, and at least one separating element arranged movably in the terminal housing, the separating element having a longitudinal axis and the two electrically conductive contact elements being connected in a first position of the separating element and disconnected in a second position of the separating element. A reduction of the space requirement for the separation point between the contact elements and the separating element during simple operation of the separating element is achieved by the contact elements being arranged consecutively in the longitudinal direction of the separating element; the separating element is arranged in the terminal housing to be movable in the longitudinal direction; and the movement direction of the separating element is different from the direction of the longitudinal extension of the terminal block.

12 Claims, 11 Drawing Sheets

(56) References Cited

U.S. PATENT DOCUMENTS

| | | | | | |
|---|---|---|---|---|---|
| 4,004,846 | A * | 1/1977 | Woertz | H01R 9/26 | 439/716 |
| 4,195,194 | A * | 3/1980 | Kuster | H01R 4/2462 | 174/59 |
| 5,120,245 | A * | 6/1992 | Robertson | H01R 4/2437 | 439/395 |
| 5,221,218 | A * | 6/1993 | Marach | H01R 13/26 | 439/637 |
| 5,320,564 | A * | 6/1994 | Anderson | H01R 9/2608 | 439/358 |
| 5,321,577 | A * | 6/1994 | Capper | H01R 4/2441 | 361/111 |
| 5,470,250 | A * | 11/1995 | Hawk | H01R 4/2491 | 439/409 |
| 5,588,880 | A * | 12/1996 | Wood | H01R 4/38 | 439/709 |
| 6,074,240 | A * | 6/2000 | Bradshaw | H01R 4/2429 | 439/412 |
| 7,404,745 | B1 * | 7/2008 | Wu | H01R 4/26 | 439/709 |
| 7,438,606 | B2 * | 10/2008 | Pizzi | H01R 4/42 | 439/793 |
| 7,559,810 | B1 * | 7/2009 | Wu | H01R 4/34 | 439/709 |
| 8,581,131 | B2 | 11/2013 | Pollmann | | |

* cited by examiner

ELECTRIC TERMINAL BLOCK WITH A SEPARATOR THAT IS DISPLACEABLE TO/FROM BETWEEN CONTACT ELEMENTS

BACKGROUND OF THE INVENTION

Field of the Invention

The invention relates to an electric terminal, especially a terminal block comprising a terminal housing, at least two electrically conductive contact elements, at least two conductor connection elements for connecting electric conductors, and at least one separating element arranged movably in the terminal housing. In the first position of the separating element, the two contact elements are connected with each other, while in a second position of the separating element, the contact elements are separated from one another.

Description of Related Art

Electric terminals have been known for decades and are used by the millions in the wiring of electrical equipment and devices. The terminals are usually snapped onto a mounting rail which, in turn, is often arranged in a series (of mounting rails) in a control cabinet. Because they are arranged next to each other on a mounting rail or because they can be arranged in a series, the terminals are usually described as terminal blocks. Screw terminals, displacement connection terminals, or spring terminals (especially spring-cage terminals or, increasingly, leg spring terminal blocks as well) are often used as conductor connection elements in terminal blocks.

The basic type of terminal block is the connecting terminal which has at least two conductor connection elements that are electrically conductively connected with one another via an electrically conductive bus bar. In addition to this basic type (which is often called a feed-through terminal), there are a number of different types of terminal blocks which are specifically adapted for particular applications. These include, among others, the so-called disconnect terminals that, by means of mechanical separating elements, deliberately interrupt a signal circuit in order to, for example, make possible a measurement of the wiring in the field. When measuring ohmic resistances or insulation, measurement-, control-, and regulation signals could negatively influence the measurements.

In the state of the art, disconnect terminals are known in which the signal circuit can be interrupted by means of a so-called separating knife. The separating knife can thereby be pivoted in the terminal housing such that, in the first position of the separating knife, the two contact elements arranged fixedly in the terminal housing are connected with each other via the separating knife, while in a second position of the separating element, the contact elements are no longer electrically conductively connected to each other.

German Patent Application DE 10 2008 014 176 A1 and corresponding U.S. Pat. No. 8,581,131 disclose a terminal block in whose housing a pivotably mounted separating knife is arranged. To make the separating knife able to pivot inside of the terminal housing, the separating knife is arranged in an insulation housing in which a pivot is molded on one side wall. This pivot is mounted in an opening in a side wall of the terminal housing. In a first position, the separating knife thereby contacts the ends (which face each other) of the two sections of the bus bar, while in a second, pivoted position of the separating knife, the two sections of the bus bar are no longer connected with each other. As the ends (which face away from the separating knife) of the sections of the bus bar are connected with the conductor connection elements, the conductor connection elements are also no longer electrically connected with each other in the second position of the separating knife.

Furthermore, terminal blocks are known from practice that have a separating slide which is arranged to slide in the terminal housing in the direction of the longitudinal extension of the terminal block. These terminal blocks, too, have a bus bar comprising two sections. The ends of the bus bar face away from each other, and each end is connected to a conductor connection element. In a first position of the separating slide, the two ends of the sections (which are arranged opposite one another in the longitudinal direction) are electrically conductively connected with each other via the slide, while in a second position, the slide is only connected with one section, so that the two sections of the bus bar are not electrically conductively connected with each other. In the case of such terminal blocks (i.e., those which have a separating slide arranged to slide in the direction of the longitudinal extension of the terminal block), the distance between the two sections of the bus bar must be selected to be appropriately large enough to ensure a reliable signal separation. As a result, the installation space necessary for the separating mechanism in the direction of the longitudinal extension of the terminal block is relatively large.

In modern electronic systems, space requirements play an increasingly large role. The reduction in size of individual components which are simultaneously supposed to have a high functionality is therefore increasingly an important challenge. The possibility of reducing the dimensions of disconnect terminals is, however, limited by the fact that these terminals must have a large dielectric strength. Furthermore, a sufficiently large air gap/creepage distance must be ensured so that the signal separation can be securely realized. In the previously mentioned known disconnect terminals, a relatively large installation space is required (due to the pivoting or sliding of the separating knife) in order to ensure that the separating knife has, in the second position, a sufficient distance from the contact elements—that is, the ends of the bus bar sections.

SUMMARY OF THE INVENTION

The object of the present invention is thus to provide an electric terminal of the initially described type in which the space requirement for the separation point between the contact elements and the separating element is reduced, and wherein the operation of the separating element remains safe and user-friendly.

This task is accomplished according to the invention by an electric terminal with the initially described characteristics in which it is provided that the contact elements are arranged consecutively in the direction of the longitudinal axis of the separating element and that the separating element is arranged in the terminal housing to be able to move in the direction of its longitudinal axis. The direction of movement of the separating element is thereby different from the direction of the longitudinal extension of the terminal. The rectilinear, translational movement of the separating element (which, however, does not coincide with the direction of the longitudinal extension of the terminal) means that the terminal can be made smaller, as the installation space necessary for the movement of the separating element out of the first position into the second position is less than, for example, the space necessary when pivoting the separating element.

Preferably, the direction of movement of the separating element is virtually perpendicular to the longitudinal extension of the terminal. As a result, the contact elements are also consecutively arranged virtually perpendicular to the longitudinal extension of the terminal and not—as is common in the state of the art—in the direction of the longitudinal extension of the terminal. This means that, if the electric terminal is oriented such that the longitudinal extension of the terminal runs horizontally, the separating element will be preferably arranged to move roughly vertically in the terminal housing, wherein the contact elements are also arranged somewhat vertically on top of each other, while the conductor connection elements are arranged consecutively in the direction of the longitudinal extension of the terminal.

The more steeply arranged in the terminal housing the separating element is, the smaller the longitudinal extension of the terminal housing can be. The direction of movement of the separating element (and thus also the arrangement of the contact elements) should preferably run virtually perpendicularly to the longitudinal extension of the terminal, although this embodiment is not absolutely mandatory. In order for the necessary space requirement for the separation point between the two contact elements to be as small as possible, the direction of movement of the separating elements should, however, preferably be at an angle of at least 45°, especially of at least 75° or more to the longitudinal extension of the terminal.

In one embodiment of the invention, it is provided that an opening is formed in the terminal housing to receive the separating element, whereby the separating element is arranged inside of the opening in the first position. In the second position, the separating element partially protrudes out of the opening on the top side of the terminal housing such that the separating element has the function of an optical indicator. In this manner, a technician can easily identify on the spot whether the signal circuit is open or closed. The separating element thereby preferably has a color that differs from the color of the terminal housing, so that visualization of the optical indicator is simplified. In the first position of the separating element, the separating element is preferably arranged far enough inside the terminal housing or opening that the upper end of the separating element is flush with the top side of the terminal housing.

According to one preferred embodiment of the terminal according to the invention, a stop is provided on the separating element and a corresponding counterstop is provided in the terminal housing—e.g., a step or an edge. The separating element is thus prevented from exiting the terminal entirely. The stop can, for example, be configured as a latching nose with a corresponding protrusion in the terminal housing. A local increase in the outer diameter of the separating element is also conceivable, so that the outer diameter of the separating element is larger in one place than the opening in the terminal housing, which prevents the separating element from exiting the terminal housing. A haptic or acoustic mark can also be formed on the separating element or in the terminal housing for the first position, so that the technician, when moving the separating element from the second position into the first position, knows precisely when the separating element is in the first position. The mark can, for example, be implemented by means of a catch mechanism.

In particular, there are various ways to implement the separating element itself. According to one advantageous embodiment of the invention, it is provided that the separating element is formed as a screw element. The screw element has a first segment and a screw-shaped second segment with an external thread. An internal thread corresponding to the external thread is formed in the opening in the terminal housing. Because the separating element is configured as a screw element, the translational movement of the separating element is induced via rotational manipulation of the screw element. In this manner, the screw element can be brought from the first position into the second position (and vice-versa) with a suitable tool directly on the top side of the terminal housing. With the help of a screwdriver, the separating element can be screwed out of the terminal housing and brought into the second position, even when the separating element is completely inside of the terminal housing in the first position. As a consequence, it is not necessary for the separating element to protrude out of the terminal housing in the first position, which removes the danger of objects, e.g., wires, catching on the separating element.

In a further preferred embodiment of the invention, it is provided that the first segment of the separating element is composed of an electrically conductive material and electrically conductively connects the contact elements with each other in the first position. The second segment, configured as a screw element, can be composed of an insulating material—a plastic, for example. As a result, assembly of the separating element is simplified, as the separating element may be manufactured using injection molding or a similar method. In the second position of the separating element, the first segment of the screw element can contact an additional contact element as long as the other contact element is no longer contacted by the conductive first segment of the screw element, so that the two contact elements are no longer electrically conductively connected with each other via the separating element.

In the case of a terminal according to the invention with a separating element configured as a screw element, it is further advantageously provided that the external thread of the second screw-shaped segment and the corresponding internal thread of the opening are each configured as coarse threads. As a result, it is possible to bring the separating element from the first position into the second position—and vice-versa—with little effort, preferably with a maximum of two rotations of the screw element. Especially preferably, the two threads are configured to be so coarse that a half rotation is sufficient. In this way, the necessary feed of the separating element can be realized via a minimal screwing- or turning motion of the screw element. Unlike conventional screws, the screw element serves not to affix a further component but rather to move the screw element, so that a finer thread is not necessary.

The electrically conductive connection between the separating element and the contact elements can preferably be simply implemented in that the first segment of the screw element is configured to be pin-shaped and the contact elements are configured as tulip contacts. This simple construction makes it possible to insert the pin-shaped, electrically conductive segment of the separating element into the tulip contact via the feed of the rotational motion of the screw element. The arrangement of the separating element relative to the contact elements can thereby be implemented in such a manner that a first, upper tulip contact in the second position is already contacted by the first segment of the screw element. The first tulip contact thus additionally serves to guide the screw element, so that the connection between the tulip contacts and the pin-shaped, electrically conductive first segment of the screw element can be more simply produced during movement into the second position. A further advantage of a pin-shaped first segment is that the first segment of the screw element can be firmly connected with the second segment of the screw element, due to the symmetrical, cylindrical form of a pin. The pin-shaped segment thus rotates with the rotational movement of the screw element during movement into the second position.

It is also possible for the first segment of the screw element to have, for example, the form of a blade or a similar angular form. Having a flat blade form, the first segment of the screw element can be fastened rotatable on the screw-shaped second segment of the screw element. If the blade-shaped first segment of the screw element is already plugged into and pushed through the first tulip contact, the first segment remains in this alignment during movement into the second position. The rotational movement of the screw element then causes only an advance of the separating element until the separating element is brought into the second position in which the first segment of the screw element also contacts the second tulip contact.

In one variation of the terminal according to the invention with a separating element designed as a screw element, it is provided that the first segment of the screw element is composed of an electrically insulating material. The first segment is thereby shovel-shaped or angular. Additionally, a spring element is provided, via which the contact elements are electrically conductively connected with each other in the first position of the screw element. In the second position of the screw element, the first, insulating segment of the screw element is, by contrast, arranged between at least one of the contact elements and the spring element. In this embodiment, the electrical connection between the contact elements is thus interrupted because the insulating segment of the screw element is, in the second position, brought in between at least one contact element and the spring element, for which purpose the spring element is deflected. One contact element may also thereby be permanently connected to the spring element. The contact elements themselves are, for example, arranged as contact surfaces on a circuit board and are electrically conductively connected with each other via the spring element as long as the separating element is in the first position. When the separating element is moved out of the first position into the second position, the insulating, shovel-shaped first segment of the separating element slides itself between the circuit board and at least one part of the spring element.

According to an alternative embodiment of the invention, the separating element is configured as a plug element. In this case, the separating element is not brought from the first position into the second by rotational movement of a screw element but rather by linear movement of the plug element. Should the separating element be built as a plug element, there are still various ways in which the separating element may be precisely designed.

Thus, in one embodiment of the invention, it is provided that the plug element is composed of an insulating material. In the first position of the plug element, the contact elements are electrically conductively connected with each other via a spring element. This connection is severed in the second position of the plug element, for which purpose at least one part of the plug element in the second position is arranged between at least one contact element and the spring element. The contact elements can, for example, be arranged as contact surfaces on a circuit board and connected with each other via the spring element as long as the separating element is in the first position. In the second position, the separating element is arranged between the circuit board and the spring element, so that the contact elements are no longer connected with each other via the spring element.

According to another embodiment of the invention, it is provided that the separating element, formed as a plug element, has an insulating first segment and an electrically conductive second segment. In the first position of the plug element, the electrically conductive segment connects the two contact elements with each other, while the connection is severed in the second position of the plug element. The electrically conductive segment can thereby be configured in various ways. It is important that it has at least two points of contact for the two contact elements. Sliding the plug element into the second position results in at least one contact element being no longer in contact with the conductive segment or a point of contact, so that the two contact elements are no connected with each other via the conductive segment.

According to a further advantageous embodiment of the invention, it is provided that, in the case of a separating element formed as a plug element, a detachable latching connection is formed between the plug element and the terminal housing in the first position. The latching connection can be configured such that, in order to move the separating element from the first position into the second position, the separating element must first be moved contrary to the direction of movement from the first position into the second position, so that the latching connection is disengaged. Following this, the separating element can be moved into the second position.

Preferably, a spring element can thereby be provided, by means of which a force is applied to the separating element so that the separating element is automatically moved into the second position after the latching connection is disengaged. First, the separating element is moved against the spring force to disengage the latching connection; then, the separating element is pushed by the spring force out of the first position into the second position. The operation is thus comparable to the operation of a ballpoint pen.

As previously stated in detail, there are different ways to configure and further develop the electric terminal block according to the invention, which can, in particular, be a terminal block. In this respect, reference is made to the following description of preferred embodiment examples in connection with the accompanying drawings.

DETAILED DESCRIPTION OF THE INVENTION

Figure 1:
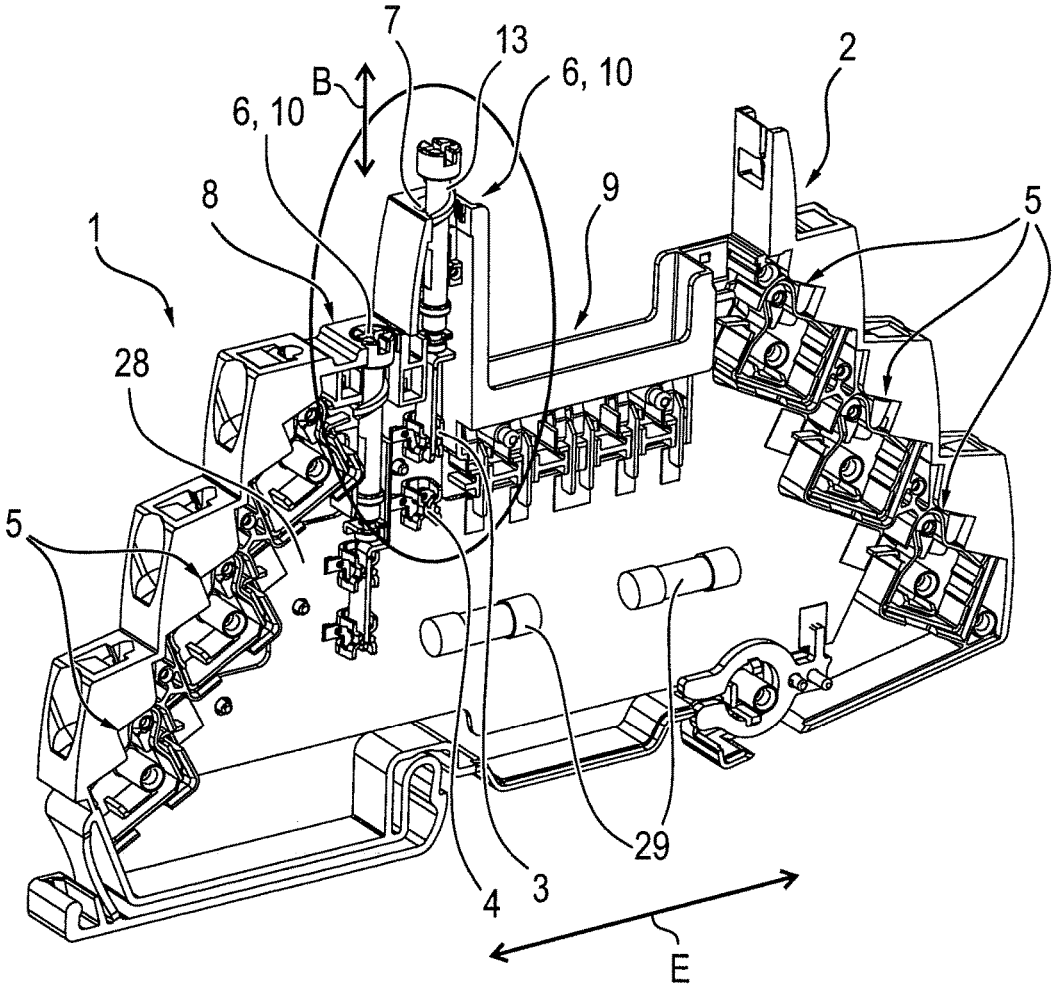
FIG. 1 shows an embodiment example of a terminal block according to the invention with a separating element designed as a screw element.

FIG. 1 shows a terminal block 1 with a terminal housing 2. Inside of the terminal housing 2, multiple contact elements 3, 4 are arranged assigned to each other in pairs, with a separation point being formed between every pair contact elements 3, 4. The terminal block 1 has three conductor connection elements 5 on each side for connecting electric conductors. To connect a pair of contact elements 3, 4 with each other, a separating element 6 is provided, and in the terminal block 1 depicted in FIG. 1, two separation points, and thus, two separating elements 6 are provided.

In the terminal block 1 shown in FIG. 1, in the encircled area, one of the separating elements 6 is in the first position, in which it is screwed all the way into the terminal housing 2, and another of the separating elements 6 is in the second position, in which it partially protrudes out of the opening 7 on the top side 8 of the terminal housing 2. If the separating element 6 is in the second position, the two contact elements 3, 4 are not connected with each other. An electric- or signal circuit, connected via two conductors on the respective conductor connection elements 5, is thus interrupted. Since the upper end of the separating element 6 protrudes out of the terminal housing 2, a technician can easily discern whether or not a connected electric- or signal circuit is interrupted.

As FIG. 1 shows, the direction of movement B of the separating element 6 is perpendicular to the longitudinal extension E of the terminal block 1. Correspondingly, the contact elements 3, 4 are also arranged one on top of the other perpendicularly to the longitudinal extension E of the terminal block 1 and not—as is usual in the state of the art—arranged consecutively in the direction of the longitudinal extension E of the terminal block 1. The conductor connection elements 5 are, by contrast, arranged consecutively in the direction of the longitudinal extension E of the terminal block 1—on the left or right face of the terminal housing 2. Thanks to this arrangement and configuration of the contact elements 3, 4 and the separating element 6, very little installation space is required for the separating element 6 to move from the first position into the second position. As a result, the terminal block 1 can be compactly designed; if the size of the terminal block 1 remains unchanged, more space is available for other components inside of the terminal block 1. A recess 9, which, for example, enables accommodation of a surge-protection element, can—with otherwise equal dimensions of the terminal block 1—thus be made considerably larger.

To prevent the separating element 6 from being unintentionally completely screwed out of the terminal housing 2, a stop 30 is provided on the separating element 6, and a corresponding counterstop 31 is provided in the terminal housing 2, so that the separating element 6 can only be screwed out of the terminal housing 2 to a maximum extent.

Figure 2A:
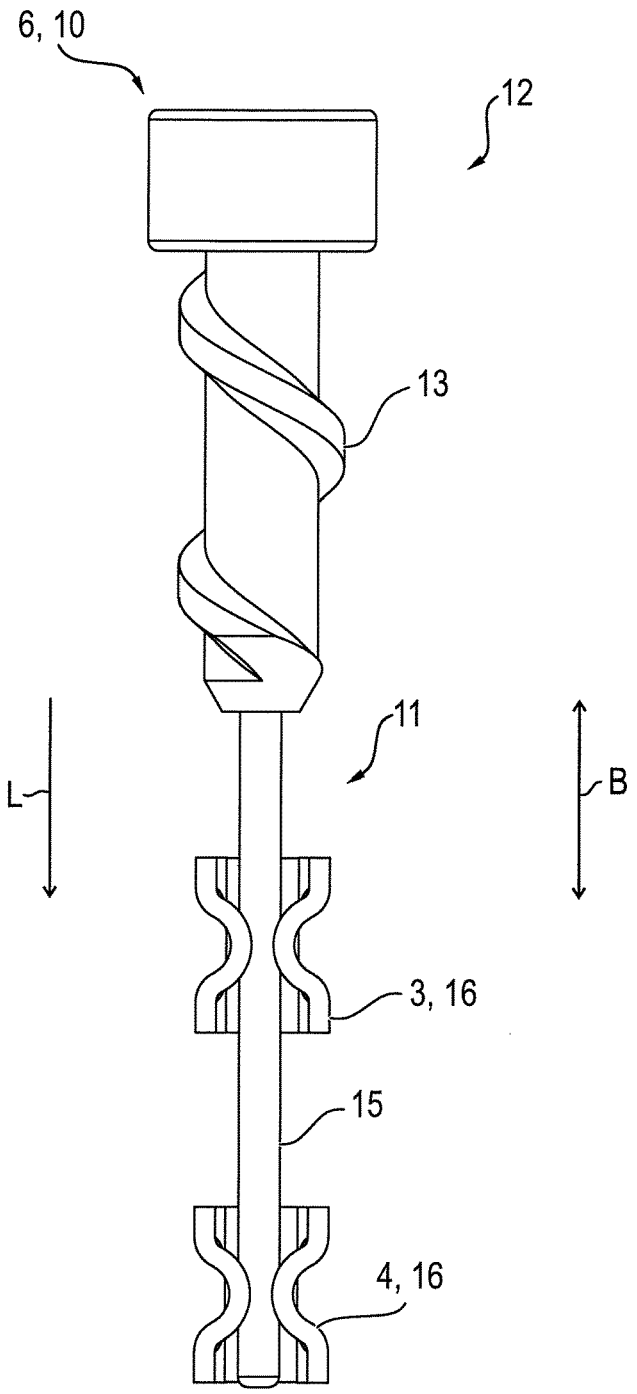
FIG. 2*a* shows an enlarged depiction of the separating element according to FIG. 1 in a state of connection with the contact elements.

FIG. 2*a* shows a separation point which is formed by a separating element 6 designed as a screw element 10 and two contact elements 3, 4. The screw element 10 has an electrically conductive first segment 11 and a screw-shaped second segment 12. An external thread 13, designed as a coarse thread, is provided on the screw-shaped second segment 12, so that one to two rotations of the screw element 10 are sufficient to separate or establish the connection between the contact elements 3, 4 arranged consecutively in the direction of the longitudinal axis L of the screw element 10. The conductive first segment 11 is thereby formed as a type of pin 15, whereby the contact elements 3, 4 are configured as tulip contacts 16. As a result, the pin-shaped first segment 11 can initially encroach into the first, upper contact element 3. When the screw element 10 is screwed in the direction of the longitudinal axis L (which runs parallel to the direction of movement B) of the separating element 6, the pin 15 is pushed through the contact element 3, so that the pin-shaped first segment 11 can encroach snugly into the second contact element 4.

Figure 2B:
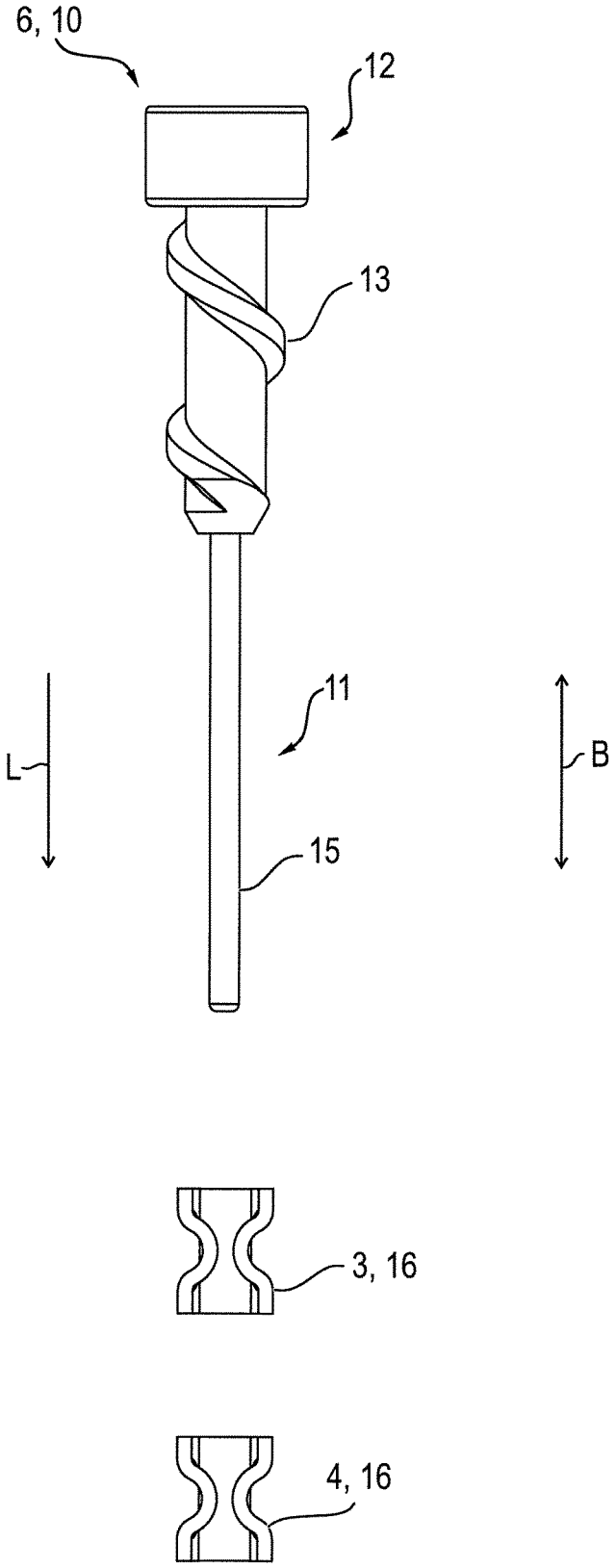
FIG. 2*b* shows the separating element according to FIG. 2*a* in a state of separation from the contact elements.

FIG. 2*b* shows the screw element 10 according to FIG. 2*a* with a separated connection. The pin-shaped first segment 11 no longer encroaches into the contact elements 3, 4, which are thus no longer electrically conductively connected with each other. The screw-shaped second segment 12 of the screw element 10 looks, in this second position on the upper side 8, out of the terminal housing 2, as the right separating element 6 in FIG. 1 shows. As a result, one can simply optically recognize that the electric connection between the two contact elements 3, 4—and thus, also between the corresponding conductor connection elements 5 of the terminal block 1—is interrupted.

Figure 3A:
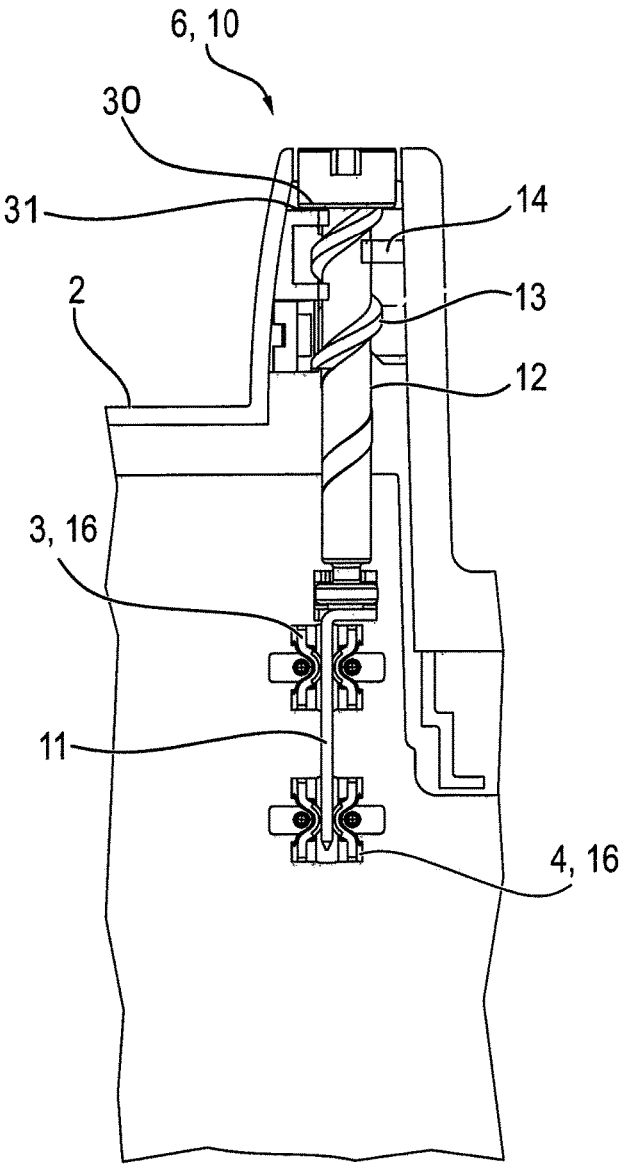
FIG. 3*a* shows a section of a terminal block with a separating element and two contact elements in a state of connection.
Figure 3B:
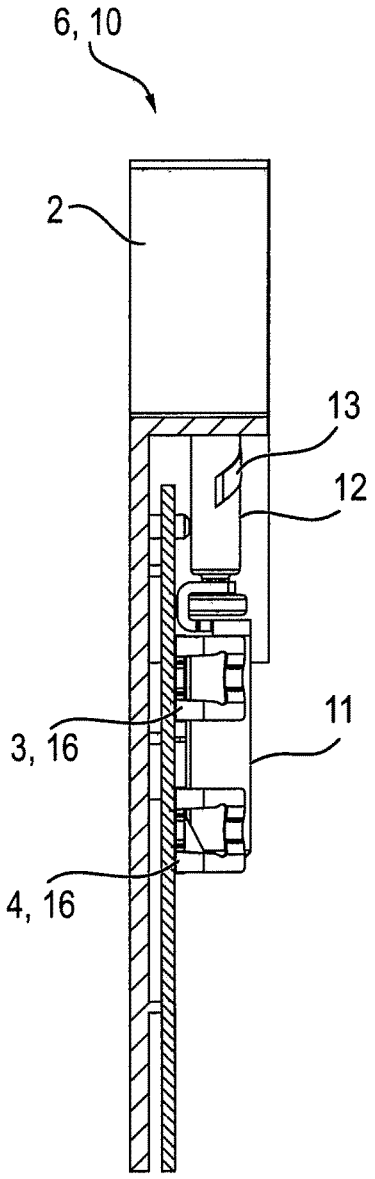
FIG. 3*b* shows a side view of the section of a terminal block with a separating element and two contact elements according to FIG. 3*a*.
Figure 3C:
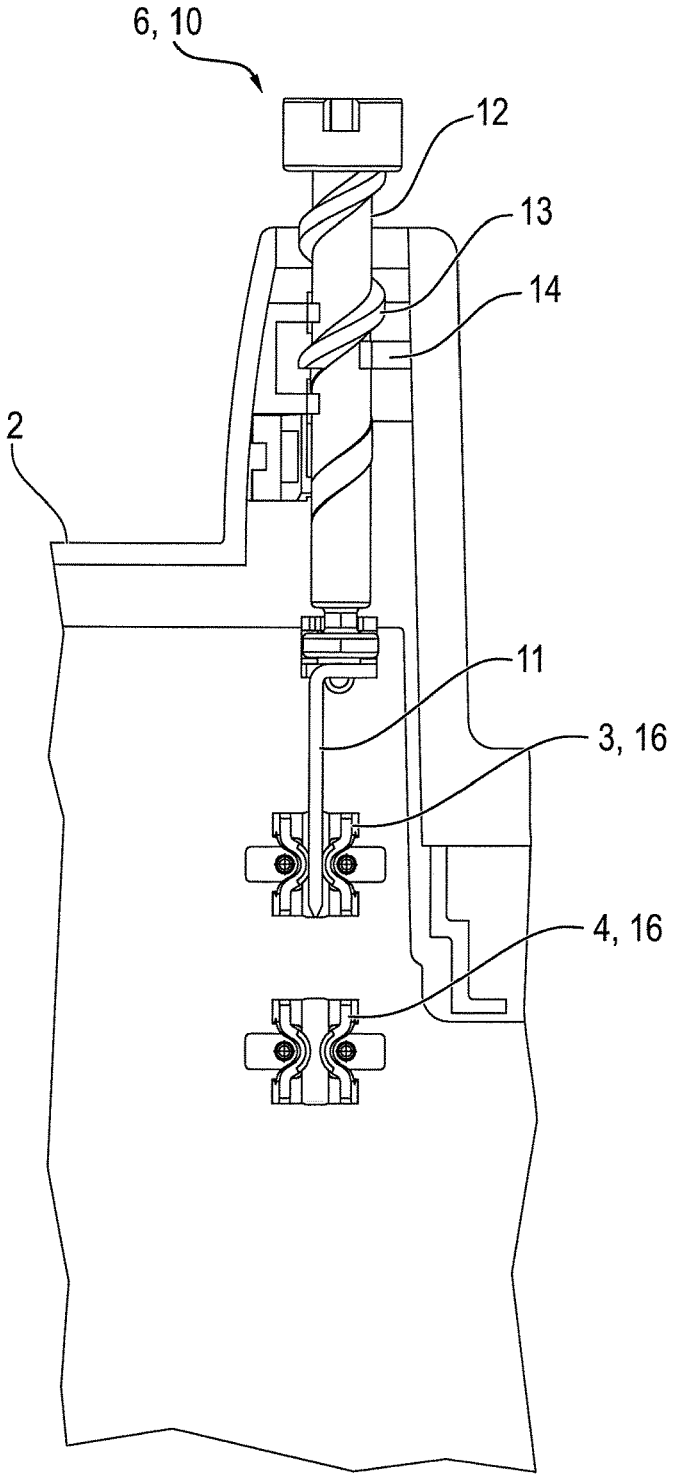
FIG. 3*c* shows the section of a terminal block with a separating element and two contact elements according to FIG. 3*a* in a state of separation.

FIG. 3 shows a section of a terminal block 1 with a separation point which is likewise formed by a separating element 6 designed as a screw element 10 and two contact elements 3, 4. FIGS. 3*a* and 3*b* show the separation point in a closed condition, in which the two contact elements 3, 4 are electrically conductively connected with each other via the separating element 6, while the separation point is shown in an open condition in FIG. 3*c*.

The screw element 10 has—similar to the screw element 10 depicted in FIG. 2—a screw-shaped second segment 12 with an external thread 13. The conductive first segment 11 is, however, not pin-shaped—like the screw element according to FIG. 2—but rather blade-shaped. The flat, blade-shaped first segment 11 thereby encroaches, in the closed condition of the separation point, into the contact elements 3, 4 (which are likewise formed as tulip contacts 16) so that the contact elements 3, 4 are electrically conductively connected with each other via the first segment 11 of the separating element 6.

In FIG. 3*b*, a side view of the embodiment of the blade-shaped first segment 11 is shown. The blade-shaped first segment 11 is rotatably attached to the screw-shaped second segment 12, so that rotation of the screw-shaped second segment 12 does not lead to rotation of the first blade-shaped segment 11. Instead, the two segments 11, 12 rotate opposite to one another as the separating element 6 is brought from the first position into the second position, or the flat, blade-shaped first segment 11 is held in its position by the upper tulip contact 16, while the screw-shaped second segment 12 performs a rotational movement.

FIG. 3*c* shows the separation point in an open state, in which the first segment 11 of the separating element is only connected with the first, upper contact element 3. An electric- or signal circuit, whose conductors are attached to the conductor connection elements 5 connected with the two contact elements 3, 4, is thus interrupted. The flat, blade-shaped first segment 11 of the screw element 10 is, in the open state of the separation point, also arranged in the first contact element 3, so that the segment 11 is, as the separating element 6 is brought into the second position, guided through the upper tulip contact 16 and remains in its orientation.

Figure 4A:
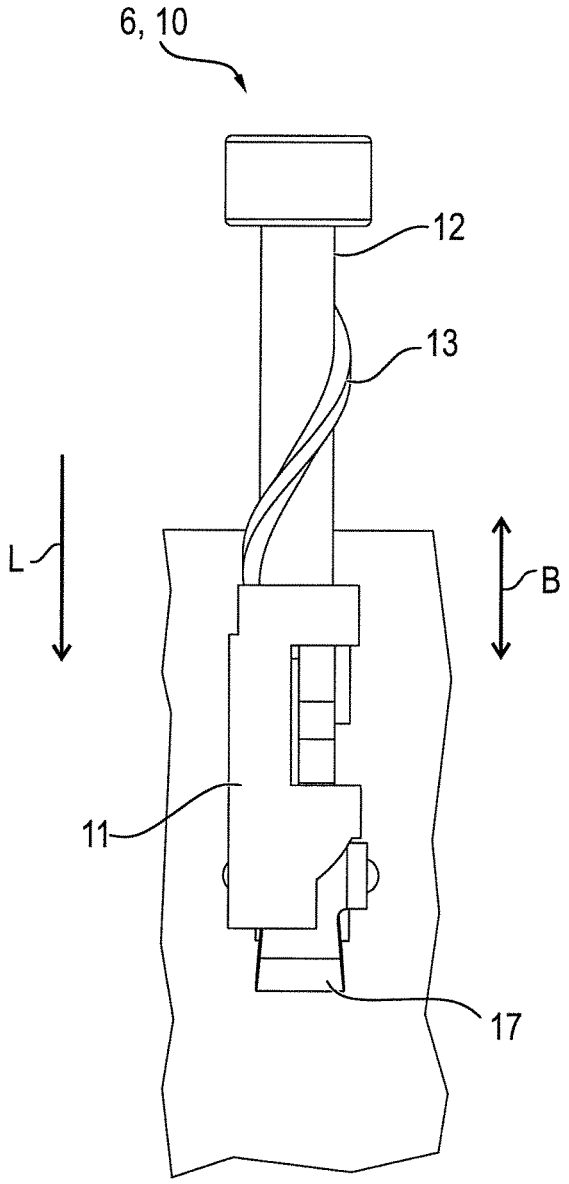
FIG. 4*a* shows an embodiment example of a separating element designed as a plug element in a state of connection with the contact elements.
Figure 4B:
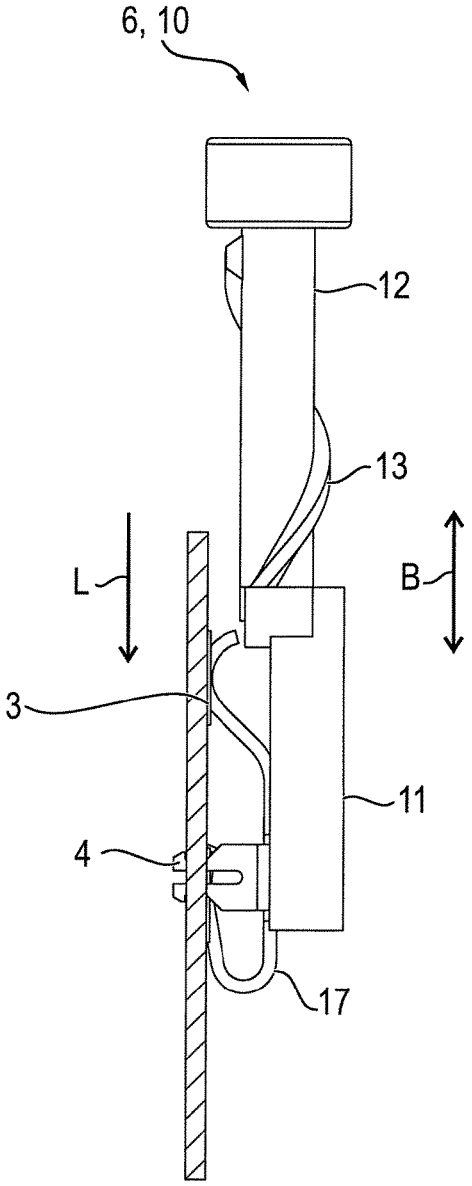
FIG. 4*b* shows a side view of the separating element according to FIG. 4*a*.
Figure 4C:
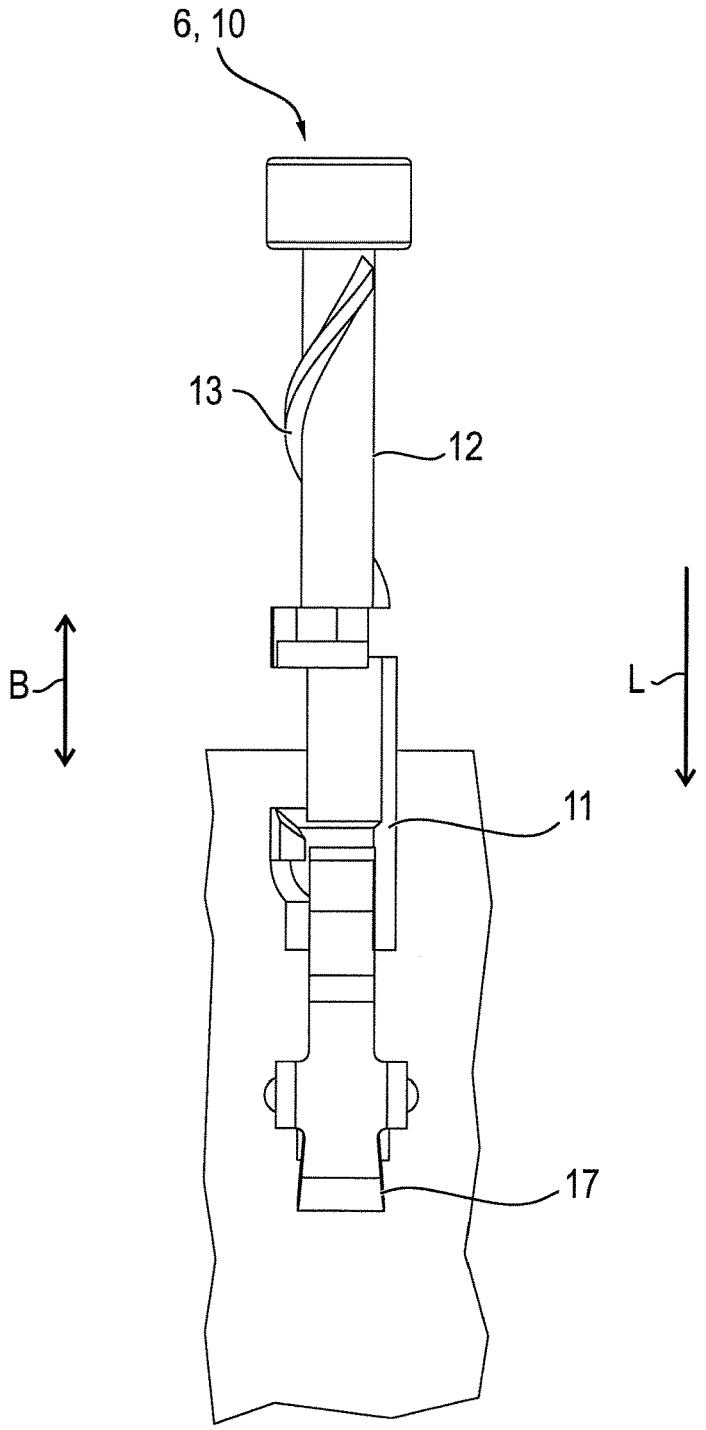
FIG. 4*c* shows the separating element according to FIG. 4*a* in a state of separation from the contact elements.

FIGS. 4*a*-4*c* show a separation point which is likewise formed by a separating element 6 designed as a screw element 10 and two contact elements 3, 4. FIGS. 4*a* and 4*b* show the separation point in a closed state, in which the two contact elements 3, 4 are electrically conductively connected with each other via the separating element 6. FIG. 4*c* shows the separation point in an open state.

In contrast to the two previous embodiment examples according to FIGS. 2 and 3, the first segment 11, this embodiment is not designed to be electrically conductive, but rather insulating. The insulating first segment 11 thereby has a shovel form, which can also be called an elongated channel form. In a closed state of the separation point according to FIG. 4*a* and FIG. 4*b*, the contact elements 3, 4 are electrically conductively connected with each other via a conductive spring element 17. The spring element 17 is firmly connected to the second, lower contact element 4, so that an electrically conductive connection is permanently present between the second contact element 4 and the spring element 17. In the closed state of the separation point—that is, when the screw element 10 is in the first position according to FIG. 4*a* and FIG. 4*b*—the upper segment of the spring element 17 is pressed by the spring force of the spring element 17 against the first, upper contact element 3. The shovel-shaped first segment 11 of the separating element 6 is thus not arranged between the contact element 3 and the spring element 17 but rather on the side of the spring element 17 that faces the contact elements 3, 4. The segment 11 of the separating element 6 is thereby arranged as a covering over the spring element 17, by means of which the spring element 17 and the contact elements 3, 4 are shielded from the insulating first segment 11.

If the screw element 10 is in the second position according to FIG. 4*c*, the electrical connection between the two contact elements 3, 4 via the spring element 17 is interrupted by the insulating first segment 11 of the screw element 10. When the screw element 10 is rotated, the shovel-shaped first segment 11, firmly connected to screw-shaped second segment 12, turns as well. The first segment 11 thereby engages the spring element 17 in such a way that the upper part of the spring element 17 (which is not firmly connected to the contact element 4) is moved away from the first contact element 3. The upper part of the spring element 17 is deflected against the force of the spring, whereby the shovel-shaped first segment 11 of the screw element 10 thrusts between the first contact element 3 and the spring element 17. Since the first segment 11 of the screw element 10 is composed of an insulating material, the electrically conductive connection between the two contact elements 3, 4 is thus interrupted.

If the screw element 10 is brought from the second position back into the first position, the shovel-shaped first segment 11 is simultaneously twisted and pushed downward in the direction of the longitudinal axis L of the separating element 6, so that the shovel-shaped segment 11 is no longer arranged between the spring element 17 and the first contact element 3. Due to the spring force of the spring element 17, the spring element 17 springs back into its original position, in which the upper part of the spring element 17 contacts the contact element 3, so that the two contact elements 3, 4 are once more electrically conductively connected with each other via the spring element 17.

Figure 5A:
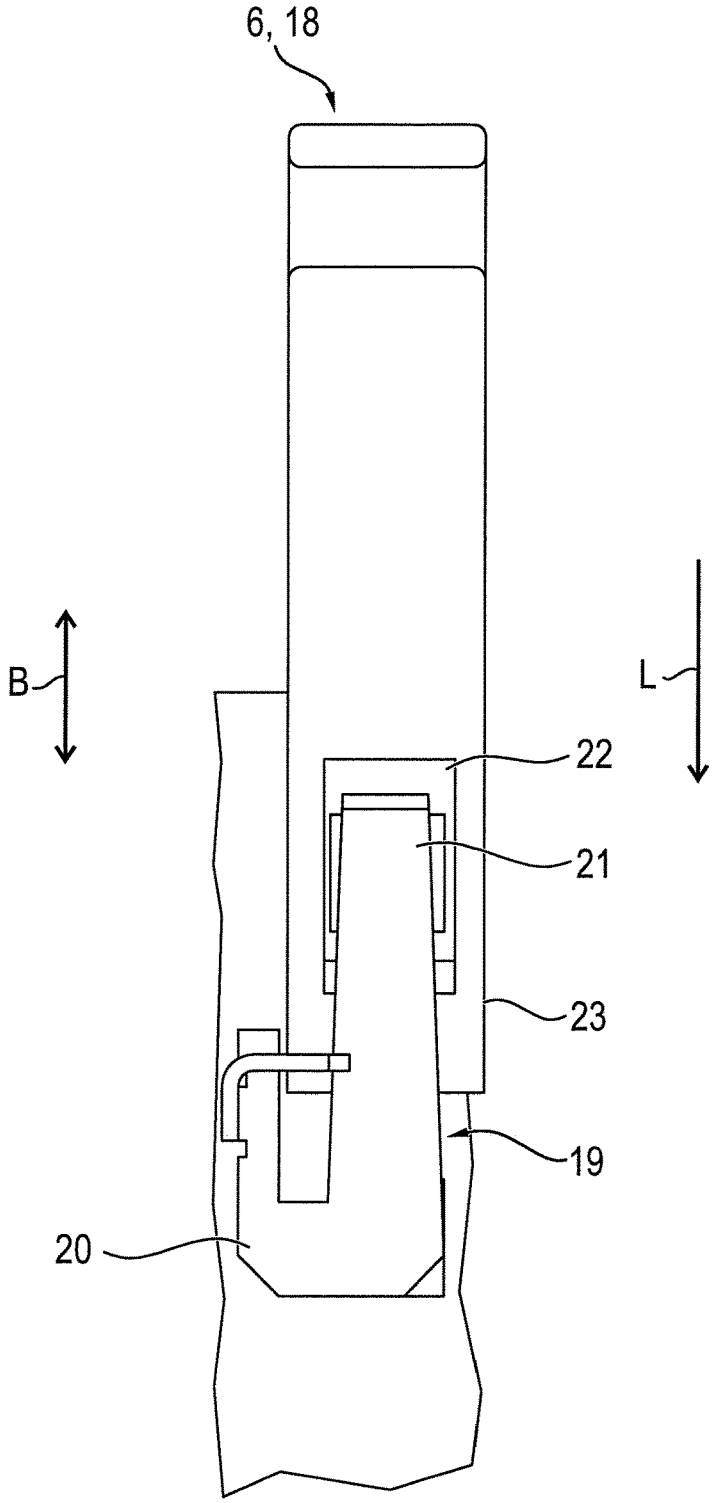
FIG. 5*a* shows a second embodiment example of a separating element designed as a plug element in a state of connection with the contact elements.
Figure 5B:
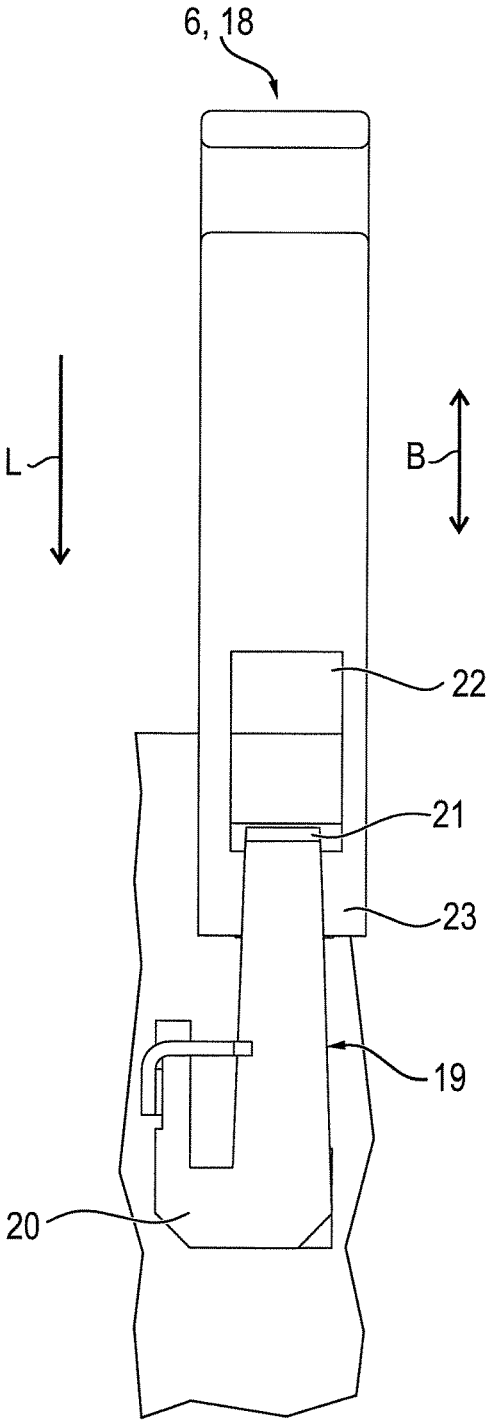
FIG. 5*b* shows the separating element according to FIG. 5*a* in a state of separation from the contact elements.
Figure 5C:
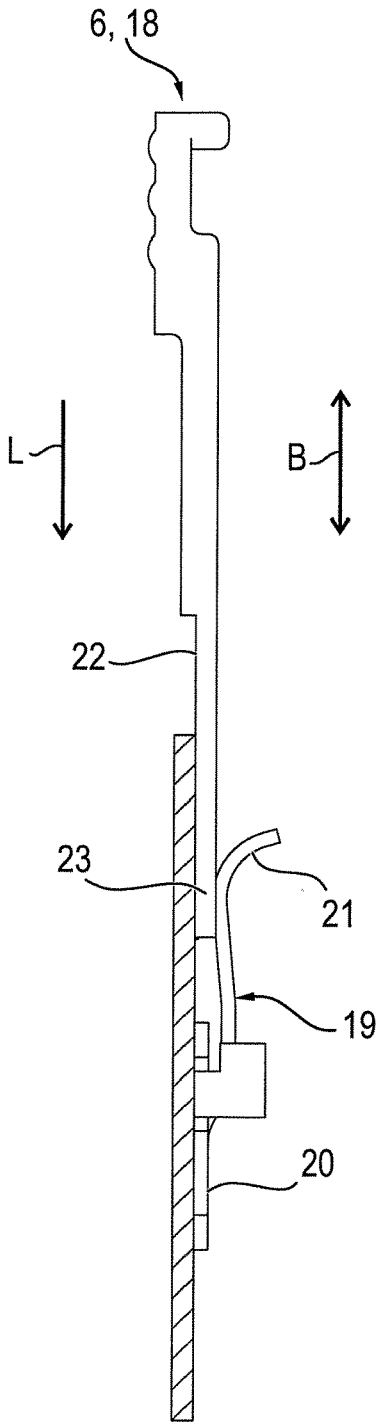
FIG. 5*c* shows a side view of the separating element according to FIG. 5*b*.

FIGS. 5*a*-5*c* show a separation point with a separating element 6 and two contact elements 3, 4, wherein the separating element 6 in this embodiment is designed not as a screw element 10, but as a plug element 18. FIG. 5*a* shows the separation point in a closed state, in which the two contact elements 3, 4 are electrically conductively connected with each other via a spring element 19, while FIGS. 5*b* and 5*c* show the separation point in an open state.

Since the separating element 6 is designed as a plug element 18, the separating element 6 is not moved from the first position into the second position by a rotational movement but rather by a simple linear movement, wherein the direction of movement B runs parallel to the direction of the longitudinal axis L of the separating element 6. The plug element 18 is composed of an insulating material, especially a plastic.

Similar to the embodiment example according to FIGS. 4*a*-4*c*, the two contact elements 3, 4 in the embodiment example according to FIG. 5 are electrically conductively connected with each other via a conductive spring element 19 when the plug element 18 is in the lower first position depicted in FIG. 5*a*. The lower part 20 of spring element 19 is thereby firmly affixed to the second contact element 4, while the upper part 21 of the spring element 19 is pressed against the upper first contact element 3 by the spring force of the spring element 19. To this end, the plug element 18 has a recess 22 through which the upper part 21 of the spring element 19 (designed as a spring arm) protrudes and thus contacts the contact element 3.

FIG. 5*b* shows the plug element 18 in the second position, in which the electrical connection between the two contact elements 3, 4 is interrupted—that is, the separation point is in an open state. In the second, upper position of the plug element 18, the recess 22 is no longer between the first contact element 3 and the upper part 21 of the spring element 19; rather, the segment 23 of the plug element 18, arranged underneath the recess 22, is between them. Since the plug element 18 is composed of an insulating material, the electrical connection between the contact element 3 and the spring element 19—and thus also the electrical connection between the two contact elements 3, 4—is interrupted. An electric- or signal circuit, connected via two conductors on the corresponding conductor connection elements 5 (which are connected with the contact elements 3, 4), is thus likewise interrupted.

FIG. 5*c* further shows that the plug element 18 deflects the spring element 19 in the second position such that the plug element 18 can be moved in between the first contact element 3 and the upper part 21 of the spring element 19. In the second position of the separating element 6, the plug element 18 also protrudes out of the opening 7 on the upper side 8 of the terminal housing 2, so that a technician can easily determine if a connected electric- or signal circuit is interrupted or not.

Figure 6A:
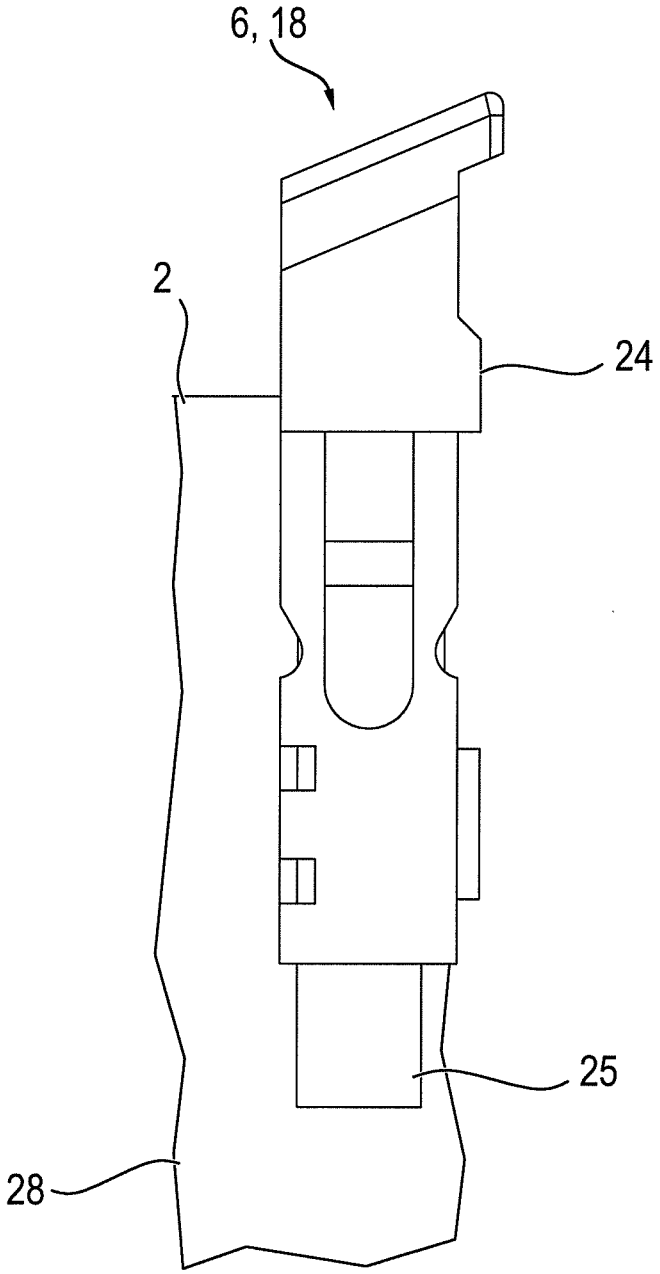
FIG. 6*a* shows a further embodiment example of a separating element designed as a plug element in a state of connection with the contact elements.
Figure 6B:
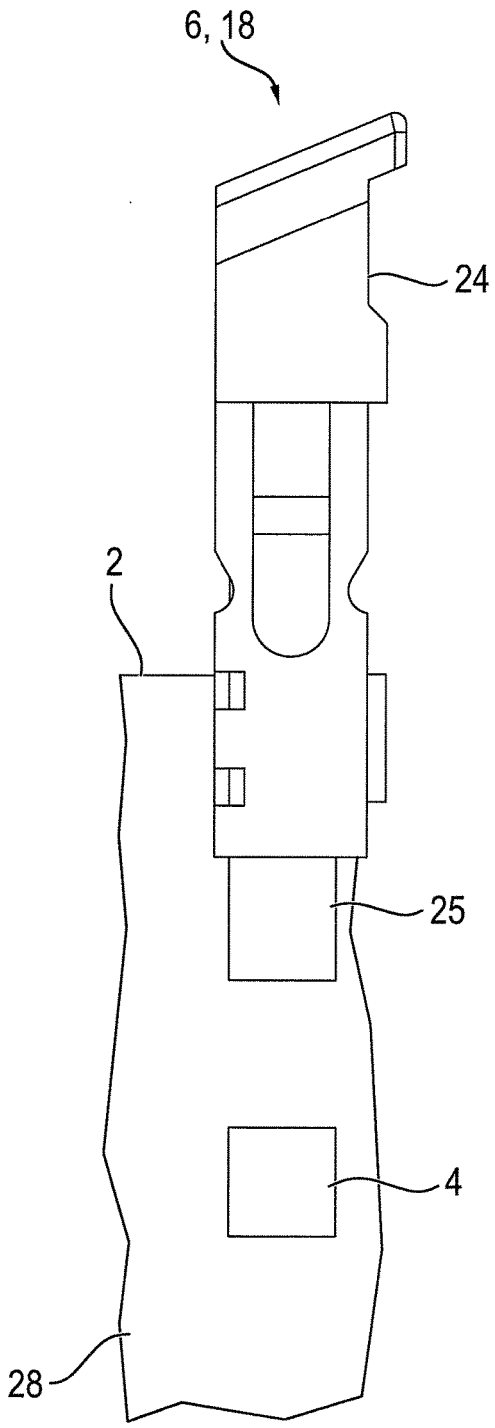
FIG. 6*b* shows the separating element according to FIG. 6*a* in a state of separation from the contact elements.
Figure 6C:
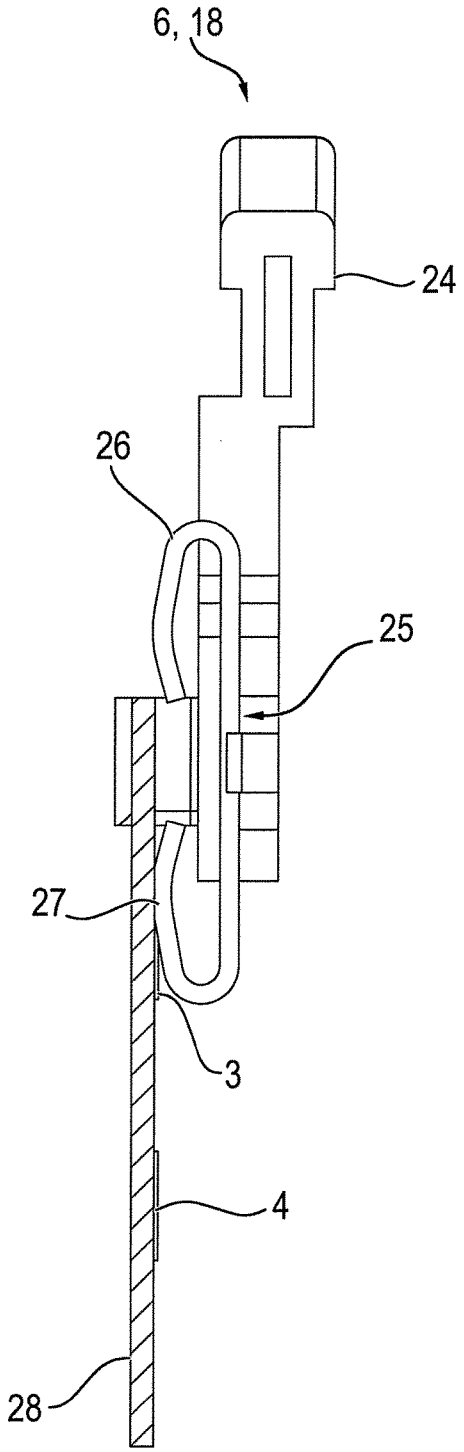
FIG. 6*c* shows a side view of the separating element according to FIG. 6*b*.

FIGS. 6*a*-6*c* show a separation point with a separating element 6 and two contact elements 3, 4, in which the separating element 6 is likewise designed as a plug element 18. FIG. 6*a* shows the separation point in a closed state, in which the plug element 18 is in the first position and the two contact elements 3, 4 are electrically conductively connected with each other via the plug element 18, while FIGS. 6*b* and 6*c* depict the plug element 18 in the second position, in which the separation point is in an open state.

In this embodiment, the plug element 18 has a first insulating segment 24 and a second electrically conductive segment 25. The electrically conductive segment 25 is thereby thinly affixed to the insulating section 24, so that both segments are moved when the plug element 18 is pushed. The conductive segment 25 is composed of an elongated, flat spring material that is bent at the ends such that two flexible segments 26, 27 exist. The two flexible segments 26, 27 are, in terms of the distance between the two, adjusted such that they correspond to the two contact elements 3, 4. In the first position, the two flexible segments 26, 27 are connected with the contact elements 3, 4, so that the two contact elements 3, 4 are electrically conductively connected with each other via the segment 25 of the plug element 18.

FIGS. 6*b* and 6*c* show that the lower contact element 4 is no longer contacted by the conductive segment 25 in the second position of the plug element 18. In the depicted embodiment example, the lower flexible segment 27 only contacts the upper contact element 3 in the second position of the plug element 18, while the upper flexible segment 26 is arranged above the upper contact element 3 without contacting it. The two contact elements 3, 4 are thereby no longer connected with each other via the conductive segment 25 of the plug element 18.

In the embodiment examples according to FIGS. 4 to 6, the contact elements 3, 4 are designed as contact surfaces that are arranged on a circuit board 28. The electrical connection between the conductor connection elements 5 and the corresponding contact elements 3, 4 thereby takes place via the circuit paths of the circuit board 28, especially depicted in FIG. 1, regardless of whether the contact elements 3, 4 are designed as tulip contacts 16 or as contact surfaces. The circuit board 28 can thereby also serve to receive and connect further components, such as fuses 29.

All of the embodiment examples depicted in the figures share the fact that the space requirement for the separation point inside of the terminal housing 2 is considerably reduced by the arrangement and embodiment according to the invention of the contact elements 3, 4 and the separating element 6. In the terminal block 1 according to the invention, the space requirement for the two separation points depicted in FIG. 1 amounts to less than $\frac{1}{3}^{rd}$ of the space required by terminal blocks 1 known prior to the present invention for a pair separation points each of which has a separating blade that is pivotably mounted in the terminal housing. The reduction is first and foremost a result of the fact that the space requirement for the pair of separation points is correspondingly decreased in the longitudinal extension of the terminal block 1, while the space requirement perpendicular to the longitudinal extension of the terminal block 1—with regard to both height and width—is virtually unchanged.

What is claimed is:

1. An electric terminal block, comprising:

a terminal housing, at least a pair of electrically conductive contact elements, conductor connection elements located at an outer side of the terminal housing and having at least two conductor elements for receiving and connecting electric conductors inserted into the terminal block, and at least one separating element arranged movably in the terminal housing, wherein the separating element has a longitudinal axis that extends crosswise relative to a direction of longitudinal extension of the terminal block, the at least one separating element being movable in directions along said longitudinal axis, wherein the pair of electrically conductive contact elements are positioned within the terminal housing spaced inward of the conductor connection elements in said direction of longitudinal extension of the terminal block, the contact elements being electrically connected to each other by the at least one separating element in a first position of the at least one separating element and electrically disconnected from each other, without disconnecting an electric conductor from a respective one of the conductor connection elements to which the electric conductor is connected, in a second position of the at least one separating element, and wherein the at least one separating element is located between the contact elements in said first position, and is displaced from between the contact elements in the direction of said longitudinal axis in said second position.

2. The electric terminal block according to claim 1, wherein an opening is formed in the terminal housing for receiving the separating element and wherein the separating element is arranged inside of the opening in the first position and partially protrudes out of the opening on an upper side of the terminal housing in the second position.

3. The electric terminal block according to claim 2, wherein the separating element is a screw element, wherein the screw element has a first segment and a screw-shaped second segment with an external thread, and wherein an internal thread corresponding to the external thread is formed in the opening of the terminal housing.

4. The electric terminal block according to claim 3, wherein the first segment of the separating element is composed of an electrically conductive material and wherein the contact elements are electrically conductively connected with each other in the first position of the separating element.

5. The electric terminal block according to claim 4, wherein the first segment of the screw element is pin-shaped and wherein the contact elements are tulip contacts.

6. The electric terminal block according to claim 3, wherein the external thread of the screw-shaped second segment of the separating element and the corresponding internal thread of the opening in the terminal housing are each formed as coarse threads, whereby no more than two turns of the screw element are required to move the screw element from the first position into the second position.

7. The electric terminal block according to claim 1, wherein a stop is provided on the separating element and a corresponding counterstop is provided in the terminal housing, the stop and counterstop, together, preventing the separating element from completely exiting the terminal housing.

8. The electric terminal block according to claim 1, wherein the separating element is a plug element.

9. The electric terminal block according to claim 8, wherein the plug element has an insulating first segment and an electrically conductive second segment, so that the electrically conductive second segment electrically conductively connects the two contact elements with each other in the first position of the plug element, while in the second position of the plug element, the contact elements are not electrically conductively connected with each other.

10. The electric terminal block according to claim 8, wherein a detachable latching connection is arranged between the plug element and the terminal housing in the first position of the plug element.

11. An electric terminal block, comprising:

a terminal housing, at least a pair of electrically conductive contact elements and conductor connection elements having at least two conductor elements for connecting electric conductors, and at least one separating element arranged movably in the terminal housing, wherein the separating element has a longitudinal axis, wherein the pair of electrically conductive contact elements are electrically connected in a first position of the separating element and electrically disconnected in a second position of the separating element, wherein the contact elements are arranged consecutively, one after the other, in a direction of the longitudinal axis of the separating element, and wherein the separating element is arranged in the terminal housing in a manner that is movable in a direction parallel to said longitudinal axis and different from a direction of a longitudinal extension of the terminal block, wherein an opening is formed in the terminal housing for receiving the separating element and wherein the separating element is arranged inside of the opening in the first position and partially protrudes out of the opening on an upper side of the terminal housing in the second position, wherein the separating element is a screw element, wherein the screw element has a first segment and a screw-shaped second segment with an external thread, and wherein an internal thread corresponding to the external thread is formed in the opening of the terminal housing, wherein the first segment of the screw element is composed of an electrically insulating material and is shovel-shaped or angular and wherein the contact elements are, in the first position of the screw element, electrically conductively connected with each other via a spring element, while in the second position of the screw element, the first segment of the screw element is arranged between at least one of the contact elements and the spring element so that the contact elements are not electrically conductively connected with each other.

12. An electric terminal block, comprising:

a terminal housing, at least a pair of electrically conductive contact elements for connecting electric conductors, and at least one separating element arranged movably in the terminal housing, wherein the separating element has a longitudinal axis, wherein the pair of electrically conductive contact elements are electrically connected in a first position of the separating element and electrically disconnected in a second position of the separating element, wherein the contact elements are arranged consecutively parallel to the longitudinal axis of the separating element, wherein the separating element is arranged in the terminal housing in a manner that is movable in a direction parallel to said longitudinal axis and different from a direction of a longitudinal extension of the terminal block, wherein the separating element is a plug element, and wherein the plug element is composed of an electrically insulating material and wherein the contact elements are, in the first position of the plug element, electrically conductively connected with each other via a spring element, while in the second position of the plug element, at least one segment of the plug element is arranged between at least one contact element and the spring element, so that the contact elements are not electrically conductively connected with each other.

* * * * *